US009284805B2

(12) United States Patent
Ageev et al.

(10) Patent No.: US 9,284,805 B2
(45) Date of Patent: Mar. 15, 2016

(54) METHOD FOR APPLYING PHYSICAL FIELDS OF AN APPARATUS IN THE HORIZONTAL END OF AN INCLINED WELL TO PRODUCTIVE HYDROCARBON BEDS

(71) Applicant: OOO "Novas Sk", Moscow (RU)

(72) Inventors: Nikita P. Ageev, Moscow (RU); Petr G. Ageev, Moscow (RU); Andrej V. Bochkarev, Moscow (RU)

(73) Assignee: OOO "NOVAS SK", Moscow (RU)

( * ) Notice: Subject to any disclaimer, the term of this patent is extended or adjusted under 35 U.S.C. 154(b) by 0 days.

(21) Appl. No.: 14/382,707

(22) PCT Filed: Jan. 24, 2014

(86) PCT No.: PCT/RU2014/000060
§ 371 (c)(1),
(2) Date: Sep. 3, 2014

(87) PCT Pub. No.: WO2015/112045
PCT Pub. Date: Jul. 30, 2015

(65) Prior Publication Data

US 2016/0002994 A1 Jan. 7, 2016

(51) Int. Cl.
*E21B 28/00* (2006.01)
*E21B 17/10* (2006.01)

(52) U.S. Cl.
CPC ..... *E21B 28/00* (2013.01); *E21B 17/1085* (2013.01)

(58) Field of Classification Search
CPC ..... E21B 7/14; E21B 7/15; E21B 10/60; E21B 43/26; E21B 29/00; E21B 43/11; E21B 28/00; E21B 7/046
See application file for complete search history.

(56) References Cited

U.S. PATENT DOCUMENTS

2015/0167440 A1* 6/2015 Kasevich ..... E21B 33/124 166/52

* cited by examiner

*Primary Examiner* — Zakiya W Bates
(74) *Attorney, Agent, or Firm* — Inventa Capitol PLC

(57) ABSTRACT

A device to affect oil-saturated layers and bottom hole zone of horizontal wells includes an emitter, a housing, presenting a double-moduled configuration, wherein the a first module and a second module are interconnected. The device includes a condenser charging unit of the first module, which is connected to an equipment that is located at a wellhead and has the capacity to transmit the data and condenser charges using a delivery tool, and a sensor that controls the force arising at the junction of the delivery tool and the device.

2 Claims, 3 Drawing Sheets

METHOD FOR APPLYING PHYSICAL FIELDS OF AN APPARATUS IN THE HORIZONTAL END OF AN INCLINED WELL TO PRODUCTIVE HYDROCARBON BEDS

FIELD OF THE INVENTION

The invention relates to the field of oil and gas industry for stimulation of production of oil, natural gas, coal gas-methane, and shale gas with the help of initiated physical fields using a device with combustible calibrated metal wire, placed in vertically inclined horizontal wells.

BACKGROUND OF THE INVENTION

In the oil and gas industry in this century the number of inclined horizontal wells have increased and their design, which enhances the productive formation drainage area has become dramatically complex. It is believed that a horizontal well may have a larger contact surface with the rock formation, which increases the recoverability coefficient of hydrocarbons from the well and its intake capacity. Hydrocarbons influx stimulation and construction, development, and maintenance of such wells are substantially different from hydrocarbon production technologies through vertical wells, and thus, the stimulation methods used for vertical wells mostly are not suitable for the horizontal wells.

For example, a horizontal well acidizing allows to penetrate only a few meters deep into the formation, however, most of the interval will remain clogged with mechanical impurities, drilling fluids, or other deposits that occur in the process of drilling, exploration, and exploitation.

The prior art methods describe stimulation of the bottom hole zone of the vertical wells by physical fields by means of creating a depression-repression pressure surges (Russian Patent Nos. RU 2276722 C1 (2006); RU 2310059 C1 (2007); RU 2373386 C1 (2009)). These methods, however, cannot be used in horizontal wells because of the device dimensions, specific design features, and its delivery into a horizontal wellbore.

The prior art methods known for the stimulation of hydrocarbons using various hydraulic fracturing (HF) methods are described in Russian Patent Nos. RU 2278955, Class E 21B 43/16, E 21 B 43/27 (2006) and Patent No 2442886 (2012). However, these proposed methods are very complicated, highly expensive, require significant preliminary preparation of the stimulation and wells, have very stringent requirements for the selection of wells for the hydro-fracturing because of the geological and technical accumulations and wells location in the field, and can be successful if all technical and technological requirements, such as formation thickness, a considerable distance from the oil-water contact (OWC) and gas-oil contact (GOC), significant formation separation, the specific selection of the fracturing and killing fluids, formation anisotropy, and reliable permeability information, are observed which a lot of times are not in the industry or information for building design effects is not sufficient. Quite often hydraulic fracturing (HF) leads to a breakthrough of formation waters and premature water breakthrough.

It is well-known that during drilling of the horizontal wells, porosity and permeability properties of the bottom hole formation are affected by invasion into the drilling fluid formation, invasion into the drilling fluid filtration layer, invasion into the cement filtration layer, perforation destruction and mother rock condensation, mechanical impurities in the completion or killing fluids penetrating into the formation or clogging perforation, invasion of the completion or killing fluids into the formation, formation clogging with natural clays, paraffin and asphaltene deposits in the formation or perforation, saline deposits in the formation or perforation, formation emulsification, and injection of solvent with mechanical impurities.

All of the above leads to a decrease in bottom hole permeability, and hence, productivity, often more than 60% of the design, and in worst cases, if damage is very deep, to the complete cessation of well production.

SUMMARY OF THE INVENTION

The proposed method of hydrocarbons stimulation into the horizontal wells allows not only to specifically decolmatage (clean/unclog) shank operating intervals, but also to utilize previously missed and poorly drained stagnant zones and streaks. This maximizes environmentally flawless operation of the well without resorting to hydraulic fracturing and acid baths at all stages of lifecycle, starting from the development. With well production rate decrease during the well operation, the proposed method makes it possible to repeat the stimulation process several times until well operation is economically viable.

The above mentioned results are achieved by the method of affecting the oil-saturated formation and a bottom hole zone of the horizontal well. The proposed method includes immersion of the device capable of explosive plasma formation into the wellbore in order to generate pulses. The proposed method is characterized in that the device is immersed sequentially first in the vertical part of the wellbore, and then, with the delivery means, to the horizontal part, wherein the delivery means is configured to transmit the necessary force to move the device along the horizontal part of the wellbore, whereas, when the pulse generating device is immersed in the horizontal direction, the force at the junction of delivery means and generating pulses device is simultaneously controlled as well as the location of the device with respect to the longitudinal axis of the borehole using centralizer, after the device has reached its target point, it is activated to form a series of successive vibrations radially propagated from the well inward the formation.

In addition, a device to affect oil-saturated layers and bottom hole zone of horizontal wells for the implementation of the above process is suggested. This device includes the housing and the emitter, wherein the housing is double-moduled, wherein the modules are interconnected. In the first module, the condenser charging unit is connected to the equipment that is located at the wellhead and has the capacity to transmit the data and condenser charges using the delivery means, and the sensor that controls the force arising at the junction of delivery means and the device, wherein in the second module, a condenser charging unit, the emitter, and a supply unit of active substance are interconnected, wherein the centralizer is located on the housing of the second module after the supply unit of active substance to ensure alignment of the longitudinal axis of the device and the longitudinal axis of the borehole.

The above results are achieved by the method of hydrocarbon production formation stimulation through the horizontal inclined wells. The method includes the device that generates periodic, directed, short pulses due to the explosion of the calibrated metal wire and formation of plasma and high-pressure shockwave and is immersed into the horizontal end of the device. The device also contains storage capacitors placed in a metal round container with an outer diameter of 42 . . . 60 mm, connected to control module and wellhead equipment capable of transmitting the charge and discharge of storage capacitors to initiate successive elastic vibrations at predetermined points in the horizontal closure. The number of pulses and the horizontal step of the emitter are defined by geological and geophysical characteristics and parameters of the well.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE INVENTION

Figure 1:
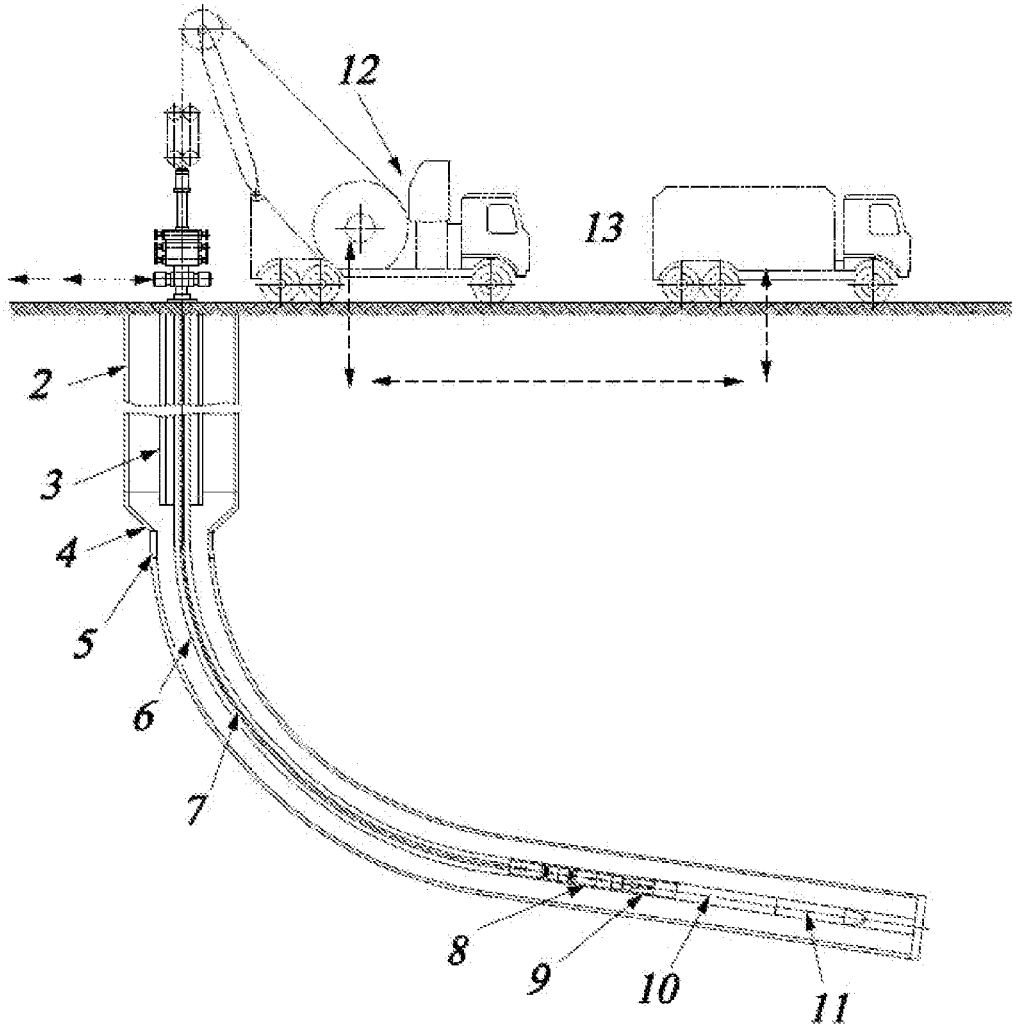
FIG. 1 illustrates a general view of a horizontal well with a device.

The proposed technical decision is illustrated by the following illustrations:

Referring to FIG. 1, a horizontal well with a device is shown, where (1) is a unit with the capacity to collect borehole fluid; (2) is a production string, D=146 mm; (3) is oil-well tubing, D=73 mm; (4) is a reentry guide of oil well tubing; (5) is a shank, D=102 mm; (6) is a flexible tube; (7) is a logging cable; (8) is a mandrel sub and reverse circulation valve; (9) is a cable head; (10) is a geophysical instrument; (11) is a standalone device; (12) is a hoist PKS 5T; (13) is a nitrogen compressor station.

Figure 2:
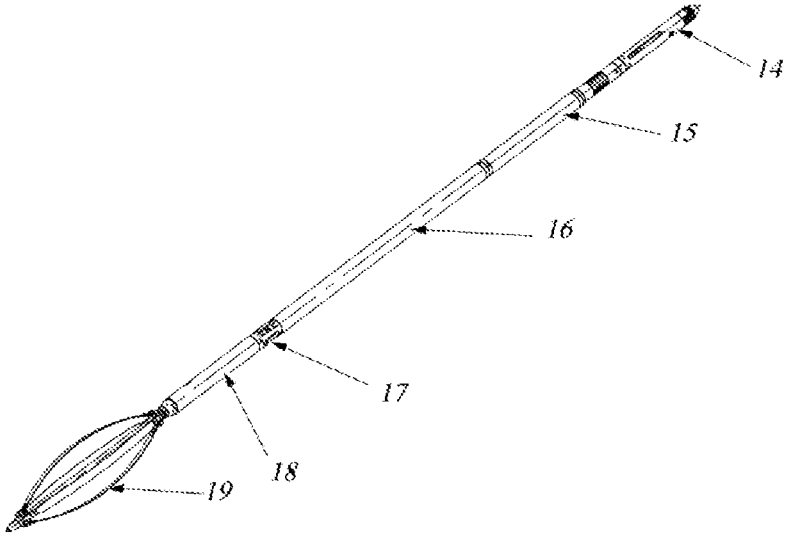
FIG. 2 illustrates a diagram of a plasma impulse excitation borehole generator.

Referring to FIG. 2, diagram of plasma impulse excitation borehole generator is shown, where (14) is a cable thimble NKB-3-36; (15) is a command and telemetry unit; (16) is an energy store unit; (17) is an emitter; (18) is a feed unit; (19) is a centralizer.

Figure 3:
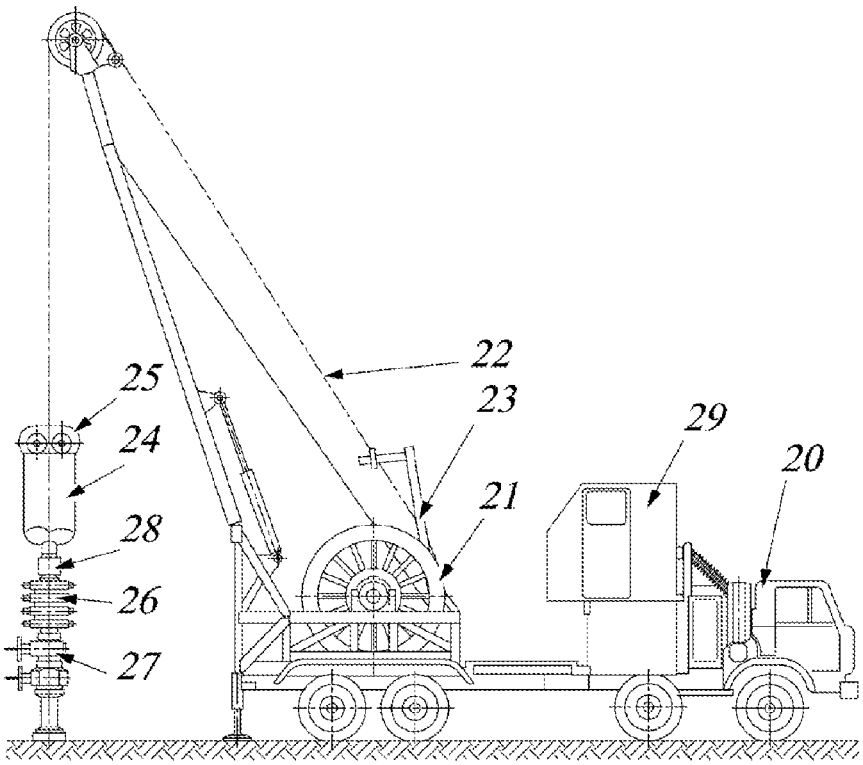
FIG. 3 illustrates a diagram of a special hoist.

Referring to FIG. 3, a principal diagram of a special hoist is shown, where (20) is transport carrier (chassis); (21) is a drum; (22) is a coil tubing unit; (23) is a drum drive, (24) is a wellhead feeder; (25) is a wellhead feeder drive; (26) is a BOP equipment; (27) is production wellhead; (28) is a wellhead stripper; (29) is an operator's cab with the control system.

The method is implemented in the following way. The device that generates periodic directed short pulses due to the explosion of the calibrated wire leading to the plasma formation and radially directed high-pressure shock wave is immersed in a horizontal well using a coil tubing unit. The device comprises a block of storage capacitors arranged in a circular metal container connected to the control module and the equipment at the wellhead with transfer capability of the charge and discharge of storage capacitors for the activation of said device in order to generate a series of successive elastic vibrations at predetermined points in the horizontal closure.

When implementing the method it is necessary to not simply immerse the device but push it downward with certain force, as opposed to working at vertical wells. For this the technology called "coil tubing" is used which is immersion into the well of oil-well tubing wound on a drum mounted on a specialized automobile chassis. The coil tubing with a special tail piece and joint at the head of the device secures a device equipped with the centralizer and pushes it into the horizontal wellbore to a predetermined depth, while to avoid an accident, the axial force is controlled by a pressure sensor communicating information to the control module. Work intervals of the horizontal closure are predefined by geophysical equipment by placing labels on the screen of the control module.

When reaching the predetermined points in the horizontal end, the operator commands to discharge condenser bank through a calibrated wire that circuits electrodes. This leads to the formation of periodic pulses of high pressure which not only decolmatage the bottom hole zone, but also increase the permeability of previously missed stagnant zones, which allows to extract hydrocarbons from the productive reservoir along the entire operating interval of the horizontal closure with maximum efficiency.

In order to effectively use this method, the well must meet the following requirements: a minimum internal diameter of the horizontal closure layout should be not less than 75 mm; casing must be sealed; direct well flushing is performed, adding a destructor to the flush fluid, if necessary, Flow areas of X-tree should be not less than 75 mm; 75 mm flow areas allow to descent the necessary technological equipment into the well.

The invention has been described above with reference to a specific embodiment thereof. The professionals can also see other embodiments of the invention that do not alter its essence, as it is disclosed herein. Accordingly, the description should be regarded as limited in scope only by the following claims.

The invention claimed is:

1. A method of affecting an oil-saturated formation and a bottom hole zone of a horizontal well, said method comprising the steps of:

immersing a device capable of explosive plasma formation into a wellbore in order to generate pulses, immersing the device sequentially first in a vertical part of the wellbore, and then, with a delivery means, to a horizontal part, configuring the delivery means to transmit the necessary force to move the device along the horizontal part of the wellbore; whereas, when the pulse generating device is immersed in the horizontal direction, the force at the junction of delivery means; and the pulse generating device are controlled simultaneously as well as the location of the device with respect to the longitudinal axis of the borehole using a centralizer, after the device has reached its target point, it is activated to form a series of successive vibrations radially propagated from the well inward the formation.

2. A device to affect oil-saturated layers and bottom hole zone of horizontal wells, said device comprising:

an emitter;

a housing, presenting a double-moduled configuration, wherein a first module and a second module are interconnected a condenser charging unit of said first module, is connected to an equipment that is located at a wellhead and has the capacity to transmit data and condenser charges using a delivery means, and a sensor that controls the force arising at the junction of said delivery means and said device, wherein in said second module, a condenser charging unit of said second module, the emitter, and a supply unit of active substance are interconnected, wherein a centralizer is located on a housing of said second module after said supply unit of active substance to ensure alignment of the longitudinal axis of said device and the longitudinal axis of a borehole.

* * * * *